United States Patent [19]

Richardson

[11] Patent Number: 4,934,625

[45] Date of Patent: Jun. 19, 1990

[54] HOLDER AND CARRIER FOR ELONGATED FLEXIBLE MEMBERS

[76] Inventor: Charles D. Richardson, 255 N. Lotus Beach Dr., Portland, Oreg. 97217

[21] Appl. No.: 358,586

[22] Filed: May 30, 1989

[51] Int. Cl.[5] ..... B65H 75/28

[52] U.S. Cl. ..... 242/85.1; 242/96

[58] Field of Search ..... 242/85, 85.1, 86, 96, 242/129, 100; 24/71.2, 71.3

[56] References Cited

U.S. PATENT DOCUMENTS

| | | | |
|---|---|---|---|
| 605,607 | 6/1898 | Koch | 242/85.1 |
| 2,438,143 | 3/1948 | Brown | 242/85.1 |
| 3,612,426 | 10/1971 | Germock, Jr. . | |
| 3,901,458 | 8/1975 | Kuncz, Jr. . | |
| 4,177,961 | 12/1979 | Gruenewald . | |
| 4,277,035 | 7/1981 | Gaski . | |
| 4,586,675 | 5/1986 | Brown . | |
| 4,616,790 | 10/1986 | Beltran | 242/85.1 |
| 4,688,739 | 8/1987 | Moore . | |
| 4,779,817 | 10/1988 | Bjork | 242/96 |

*Primary Examiner*—Stuart S. Levy
*Assistant Examiner*—Steven M. duBois
*Attorney, Agent, or Firm*—Klarquist, Sparkman, Campbell, Leigh & Whinston

[57] ABSTRACT

A holder and carrier for elongated flexible members such as rope, garden hoses or electrical cables is disclosed. The holder has a planar base member having a top portion and a bottom portion. The top of the base member has an elongated aperture or opening near the top to function as a handle. Additional opening are provided to attach the base member to an existing wall structure. A pair of arms are attached to the bottom portion of the base member. The arms lie in a common plane. The arms attach to the bottom portion of the base member such that the plane of the arms intersect the plane of the base member at an acute angle.

9 Claims, 1 Drawing Sheet

HOLDER AND CARRIER FOR ELONGATED FLEXIBLE MEMBERS

TECHNICAL FIELD

This invention relates to a holder and carrier for elongated flexible material such as rope, garden hose or electrical cables or cords.

BACKGROUND OF THE INVENTION

Various devices have been designed to hold elongated flexible members such as hoses, electrical cable and rope. Simple devices such as the Extension Cord Caddy described by Germock, Jr. in U.S. Pat. No. 3,614,426 merely use a formed wire stock arm pivoting on a flat base for containing electrical extension cords. More complex units such as the Tangle Free Cord Holder described by Brown in U.S. Pat. No. 4,586,675 are molded plastic units with multiple arms hinged in the center. These units although adequate for small diameter elongated flexible members such as electrical extension cords would not function well for larger diameter elongated flexible members such as garden hoses.

A more universal holder must be able to accommodate small and large diameter elongated flexible members, be transportable and yet have provision for mounting to a vertical wall structure. It is a principal object of the present invention to provide a holder and carrier for elongated flexible members which permits the removal of the stored member either in its entirety or in selected amounts.

It is a further object of the present invention to provide a holder and carrier for elongated flexible members which can be disassembled and reassembled quickly for storage and shipping.

Another object is to provide a holder for elongated flexible members which can be easily carried from place to place with the member thereon and easily mounted to a wall or the like.

Still another object of the invention is to provide a holder and carrier for elongated flexible members which is inexpensive to manufacture and is convenient to use.

DISCLOSURE OF THE INVENTION

The holder and carrier of the present invention has a generally planar base member. The top of the base member has an elongated aperture to be used as a handle. The base member has a generally flat back and a front wherein the bottom portion of the front is thicker than the top portion of the front. Two arms releasably engage the bottom portion of the front of the base member. The arms define a plane. The intersection of the plane of the arms and the plane of the base member forms an acute angle. The elongated flexible members to be stored on the holder are looped about the arms between the arms and the base member. Keyhole slots are provided through the top portion of the base member for hanging the carrier to an existing wall structure.

Other objects and advantages of the present invention will be apparent from the following description of a preferred embodiment thereof and from the attached drawings.

DETAILED DESCRIPTION

Figure 1:
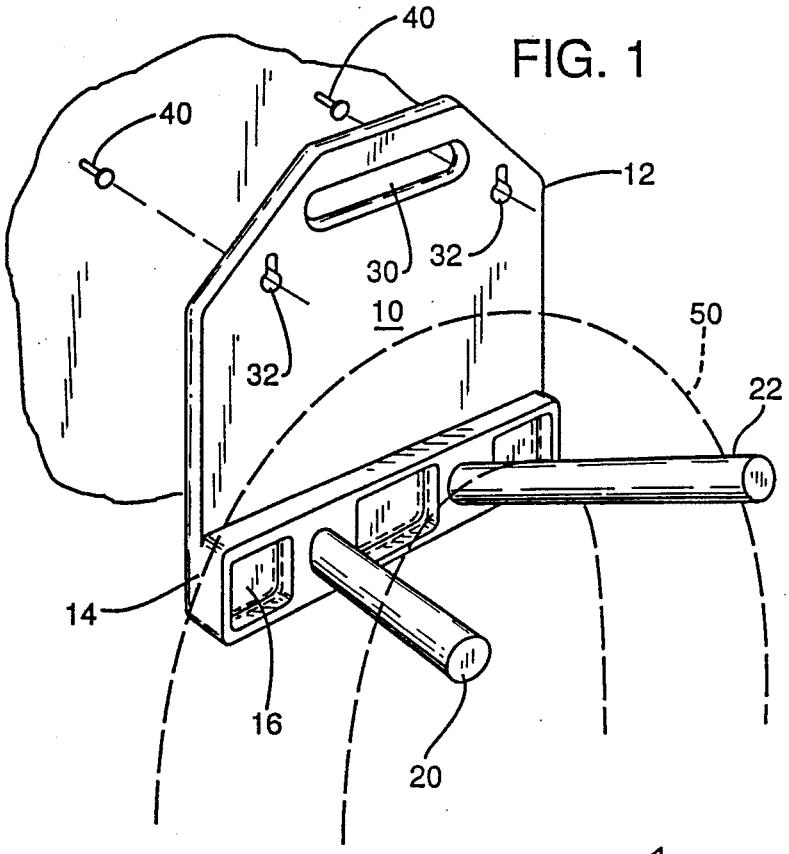
FIG. 1 is a perspective view of the holder and carrier of the present invention.
Figure 2:
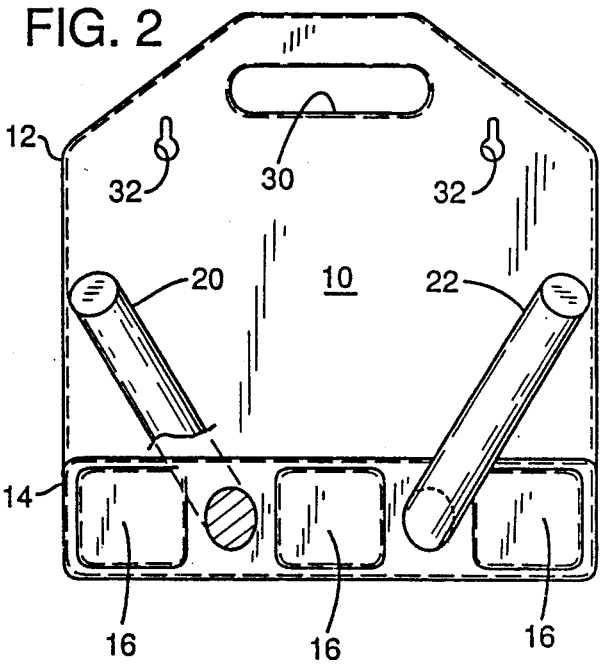
FIG. 2 is a front view of the holder and carrier of the present invention.
Figure 3:
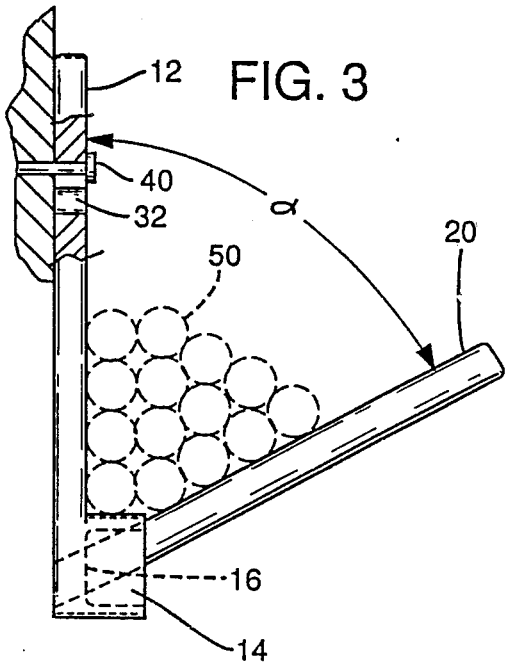
FIG. 3 is a partly in section side view of the holder and carrier of the present invention.

Referring to FIG. 1, the holder of the invention comprises a base member 10 made of suitable material such as wood or injection molded thermoplastic material. The base member 10 is generally rectangular having a top, a bottom, a front and a back. The back of the base member is generally flat while the front has a bottom portion 14 which is thicker than the top portion 12. The thickened bottom portion 14 of the front may have weight saving cutouts or depressions 16. The purpose of the thickened bottom portion 14 is to receive arms 20 and 22 in suitable openings formed therein. Arms 20 and 22 are skewed from one another as shown in FIG. 2 and define a plane. The plane of the arms intersects the plane of base member 10 along a horizontal line with the plane of the arms defining an included acute angle $\alpha$ with the plane of the base member 10, as shown in FIG. 3. Within the plane of the arms, the arms 20 and 22 may be parallel, but are preferably at an angle which may be a 90 degree angle, an acute angle or an obtuse angle.

Figure 4:
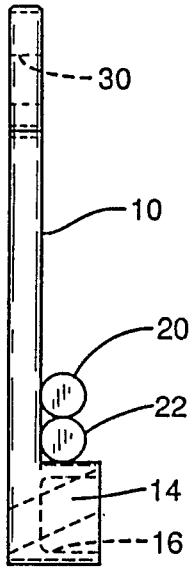
FIG. 4 is a side elevation of the holder and carrier prepared for shipment or storage.

Arms 20 and 22 may be circular in cross-section and may be injection molded thermoplastic, plastic rod stock or wood. The end of each arm may be threaded to engage matching threads in the openings in the base member bottom portion 14. In an alternate embodiment, the ends of the arms may be slightly tapered to fit matching tapered holes in the base member bottom portion 14. Either attachment method can allow the arms to be easily and quickly removed from the base member 10 for storage or shipping and placed on the front of the base member 10 above the thickened bottom portion 14 as shown in FIG. 4 and can quickly and easily be reinstalled to the base member 10. An elongated opening 30 is provided near the top portion 12 of base 10 member for use as a handle for carrying the elongated flexible member. Keyway slots 32 or other openings may be provided near the top of base member 10 for engaging screws or nails 40 in a wall structure for holding the holder or carrier upright against the wall.

As indicated in FIGS. 1 and 2 to store an elongated flexible member 50 such as a hose, member 50 is looped over arms 20 and 22 and lies against the arms at the bottom portion 14 of base member 10. The member 50 can be easily removed, coil by coil, or in its entirety from the holder, or if desired the holder can be grasped through the opening 30 and carried to another location.

It will be understood that the invention is not to be limited to the specific construction or arrangement of parts shown but that they may be widely modified within the invention defined by the claims.

I claim:

1. A holder and carrier for elongated flexible members comprising:

a generally rectangular planar base member having a top portion and a bottom portion;

a handle comprised of an elongated aperture through the top portion of the base member;

a pair of removable rigid arms attached to the bottom portion of the base member;

said arms defining a plane; and said plane of the arms intersecting the plane of the base member along a horizontal line and defining an included acute angle between the plane of the base member and the plane containing the arms.

2. A holder and carrier for elongated flexible members comprising:

a base member being generally planar with a front surface and a back surface, said front surface having a top portion and a bottom portion thereon;

at least two rigid arms removably attached to the bottom portion of the base member projecting upwardly therefrom;

the two arms skewed to one another defining a plane;

the plane of the arms intersecting the front surface of the base member along a horizontal line near the bottom portion thereof and defining an included acute angle between the plane of the base member and the plane of the arms; and a bounded elongated aperture near the top portion of the base member for use as a handle.

3. The holder and carrier as recited in claim 2 wherein the arms have a circular cross section, and the arms threadably engage the base member.

4. The holder and carrier as recited in claim 2 wherein the bottom portion of the base member is thicker than the top portion of the base member.

5. The holder and carrier as recited in claim 2 wherein the base member and the arms are molded of polyemric material.

6. The holder and carrier as recited in claim 2 wherein the arms are skewed within the plane of the arms at an angle to one another.

7. The holder and carrier as recited in claim 2 wherein the arms are parallel to one another.

8. A holder and carrier for receiving and holding an elongated continuously flexible member comprised of:

a molded generally bounded plastic base member having a top portion and a bottom portion;

an elongated aperture molded near the top portion of the base member;

the bottom portion of the base member thicker than the top portion; and a pair of arms removably engaged to the bottom portion of the base member such that a plane containing the arms forms an acute angle to the base member.

9. A holder and carrier as recited in claim 8 wherein the base member has a means to attach the base member to an existing wall.

* * * * *